US006575103B1

(12) United States Patent
Holdredge et al.

(10) Patent No.: US 6,575,103 B1
(45) Date of Patent: Jun. 10, 2003

(54) CONVERTIBLE TABLE AND EASEL

(75) Inventors: Russell T. Holdredge, Alto, MI (US); Christopher Fuller, Grand Rapids, MI (US); James A. Konyndyk, Kentwood, MI (US); Ronald L. Whitwam, Caledonia, MI (US)

(73) Assignee: Steelcase Development Corporation, Caledonia, MI (US)

( * ) Notice: Subject to any disclaimer, the term of this patent is extended or adjusted under 35 U.S.C. 154(b) by 168 days.

(21) Appl. No.: 09/626,476

(22) Filed: Jul. 26, 2000

(51) Int. Cl.[7] ..... A47B 3/02
(52) U.S. Cl. ..... 108/118; 108/12
(58) Field of Search ..... 108/118, 11, 147.22, 108/144.11, 12

(56) References Cited

U.S. PATENT DOCUMENTS

| | | | | |
|---|---|---|---|---|
| 163,122 | A | 5/1875 | Wheeler | |
| 173,269 | A | 2/1876 | Chinnock | |
| 275,598 | A | 4/1883 | Crandall | |
| 346,795 | A | 8/1886 | Wilcox | |
| 362,589 | A | 5/1887 | Shinn | |
| 415,371 | A | 11/1889 | Smith | |
| 511,466 | A | 12/1893 | Selden | |
| 827,949 | A * | 8/1906 | Wilkins | 108/118 |
| 948,905 | A | 2/1910 | Snyder | |
| 1,200,071 | A | 10/1916 | Barler | |
| 1,406,592 | A | 2/1922 | O'Neal Watkins | |
| 1,898,514 | A | 2/1933 | Wilhelm | |
| 1,912,096 | A | 5/1933 | Reuter | |
| 1,981,052 | A | 11/1934 | Lehner | |
| 2,191,099 | A | 2/1940 | Shenton | |
| 2,285,778 | A | 6/1942 | Milward | |
| 2,397,405 | A | 3/1946 | Burkeman | |
| 2,741,868 | A | 4/1956 | Saunders | |
| 3,017,969 | A | 1/1962 | Nielsen | |
| 3,298,537 | A | 1/1967 | Di Marco | |
| 3,640,228 | A | 2/1972 | Busse | |
| 3,785,299 | A | 1/1974 | Caperton, Jr. | |
| 4,099,469 | A | 7/1978 | Sahli | |
| 4,117,781 | A | 10/1978 | Middleton et al. | |
| 4,714,224 | A | 12/1987 | Calmes | |
| 5,358,204 | A * | 10/1994 | Terada | 108/118 |
| D368,165 | S | 3/1996 | Foster | |
| 5,501,423 | A | 3/1996 | Roberts | |
| 5,518,217 | A | 5/1996 | Deutsch et al. | |
| 6,039,392 | A | 3/2000 | Dencker | |

* cited by examiner

*Primary Examiner*—Lanna Mai
*Assistant Examiner*—Jerry A. Anderson
(74) *Attorney, Agent, or Firm*—Price, Heneveld, Cooper, DeWitt & Litton

(57) ABSTRACT

A table/easel that includes a worksurface having an erasable surface, at least one first leg pivotally coupled to the worksurface, and at least one second leg pivotally coupled to the worksurface. The table/easel further includes a first pivot block and a second pivot block interconnecting the first and second legs in a scissor-like arrangement. The first and second pivot blocks are slidably coupled to the first and second legs. The first and second leg can be slidably adjusted with respect to the first and second pivot blocks, thereby allowing infinite adjustability of the worksurface between a substantially horizontal position and a substantially vertical position.

18 Claims, 4 Drawing Sheets

CONVERTIBLE TABLE AND EASEL

BACKGROUND OF THE INVENTION

The present invention relates to a convertible table and easel, and in particular to a table adjustable between a horizontal position, wherein the tabletop can be used as a worksurface, and a substantially vertical position, wherein the tabletop can be used as an easel.

As the cost for office space increases, companies continue to seek ways to make use of limited space, and also of those spaces within a given work environment heretofore unutilized. This task is complicated, as the increasingly diverse office equipment required by the average worker increases. Each piece of office equipment typically has an independent use, requiring the purchase and storage of a piece of office equipment for each and every task.

SUMMARY OF THE INVENTION

One aspect of the present invention is to provide a table/easel, including a worksurface having an erasable surface, at least one first leg pivotally coupled to the worksurface, and at least one second leg pivotally coupled to the worksurface. The table/easel further includes a first pivot block and a second pivot block interconnecting the first and second legs in a scissor like arrangement. The first and second pivot blocks are slidably coupled to the first and second legs. The first and second leg can be slidably adjusted with respect to the first and second pivot blocks, thereby allowing infinite adjustability of the worksurface between a substantially horizontal position and a substantially vertical position.

Another aspect of the present invention is to provide a table/easel that includes a tabletop defining a top worksurface and a bottom surface, at least one first leg pivotally coupled to the tabletop and at least one second leg pivotally coupled to the tabletop. The table/easel further includes a first pivot block and a second pivot block interconnecting the first and second legs in a scissor-like arrangement. The first and second pivot blocks are telescopingly coupled to the first and second legs. The first and second leg can be telescopingly adjusted with respect to the first and second pivot blocks, thereby allowing infinite adjustability of the worksurface between the storage position, wherein the legs are collapsible against the bottom surface of the tabletop, and an in-use position, wherein the legs extend away from the tabletop.

Yet another aspect of the present invention is to provide a method for displaying information on a worksurface that includes providing a tabletop that includes at least one edge and worksurface having an erasable surface, and providing a plurality of legs attached to the tabletop, wherein the legs are adapted to support the worksurface in a substantially horizontal position. The method further includes tilting the worksurface to a substantially vertical position, wherein the tabletop is supported by at least one of the legs and the edge of the tabletop, thereby supporting the worksurface in a substantially vertical orientation.

Yet still another aspect of the present invention is to provide a convertible furniture unit that includes a worksurface panel with an erasable surface, a pair of intersecting legs pivotally attached to the worksurface panel, and a bracket interconnecting the intersecting legs which is securely respositionable along the lengths of each of the legs and wherein the length of one of the legs is adjustable.

The table/easel of the present invention provides a table usable as a worksurface and/or an easel, thereby reducing the costs associated with purchasing, as well as reducing the area of required office space. The present inventive table/easel can be operated by even unskilled office personnel, is efficient in use, is economical to manufacture, and is particularly well adapted for the proposed alternative uses.

These and other advantages of the invention will be further understood and appreciated by those skilled in the art by reference to the following written specification, claims and appended drawings.

DETAILED DESCRIPTION OF PREFERRED EMBODIMENTS

Figure 1:
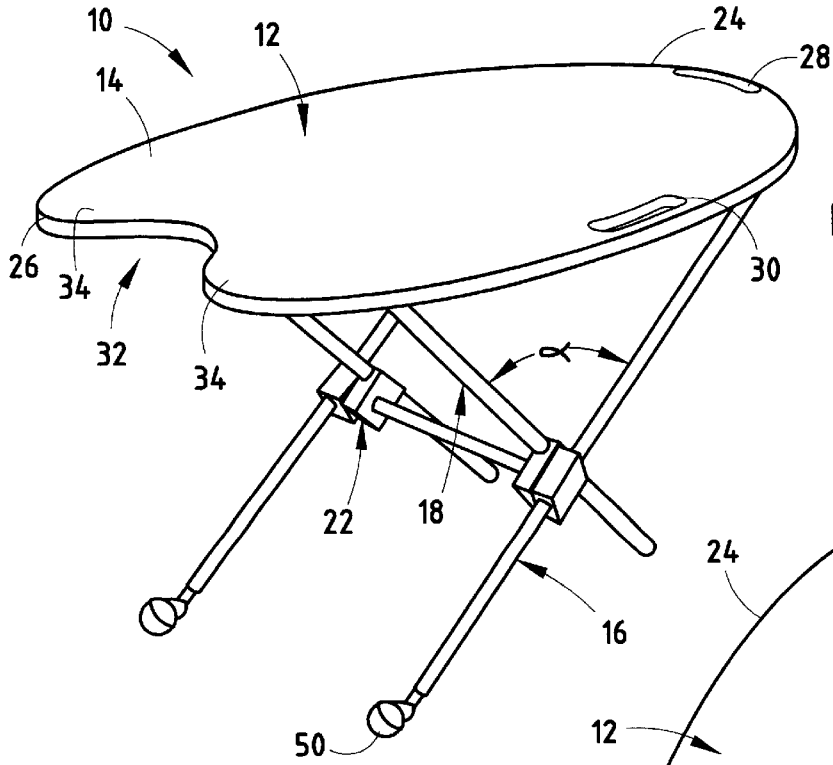
FIG. 1 is a perspective view of a table/easel embodying the present invention, with a worksurface in a substantially horizontal position.
Figure 9:
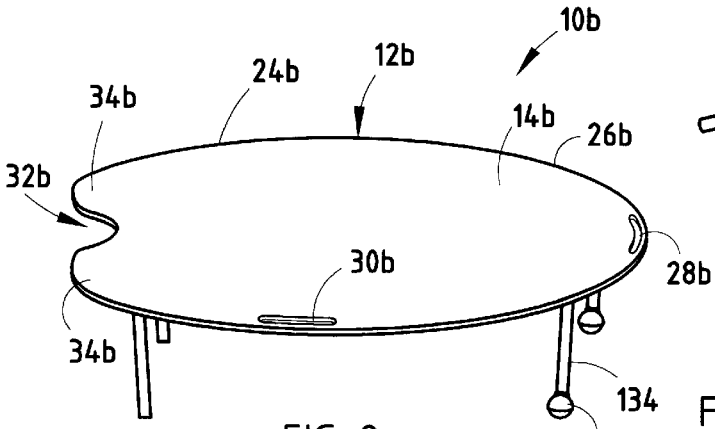
FIG. 9 is a perspective view of an alternative embodiment of the table/easel with the worksurface in a substantially horizontal position.

For purposes of description herein, the terms "upper," "lower," "right," "left," "rear," "front," "vertical," "horizontal," and derivatives thereof shall relate to the invention as oriented in FIGS. 1 and 9. However, it should be understood that the invention may assume various alternative orientations and step sequences, except where expressly specified to the contrary. It should also be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly stated otherwise.

Figure 2A:
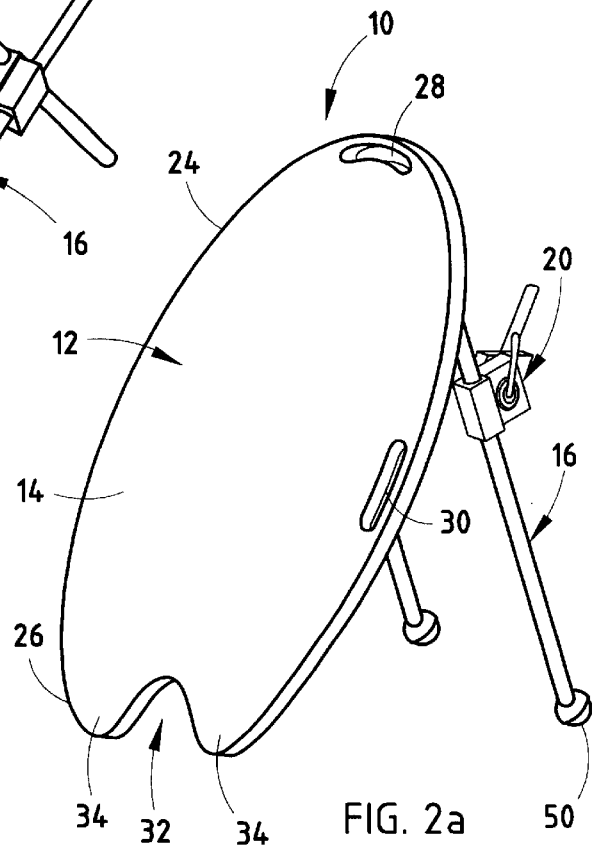
FIG. 2*a* is a front perspective view of the table/easel, with the worksurface in a substantially vertical position.

The reference 10 (FIG. 1) generally designates a table/easel embodying the present invention. In the illustrated example, table/easel 10 includes a tabletop 12 having a worksurface 14 with an erasable surface. The table/easel 10 also includes a U-shaped first leg 16 pivotally coupled to worksurface 14, and a U-shaped second leg 18 also pivotally coupled to worksurface 14. The table/easel 10 further includes a first pivot block 20 and a second pivot block 22 that interconnect the first leg 16 and second leg 18 in a scissor-like arrangement defining an angle $\alpha$ therebetween. The first pivot block 20 and second pivot block 22 are slidably coupled with first leg 16 and second leg 18. The first leg 16 and second leg 18 can be slidably adjusted with respect to first pivot block 20 and second block 22, thereby allowing infinite adjustability of worksurface 14 between a substantially horizontal position, as shown in FIG. 1, and a substantially vertically position, as shown in FIG. 2*a*.

The tabletop 12 is provided a substantially oval-shaped geometry, and includes a first end 24 and a second end 26. The first end 24 of tabletop 12 includes an arcuate-slotted handle 28 extending therethrough. A second slotted handle 30 also extends through tabletop 12 near an edge thereof. Slotted handles 28 and 30 are adapted to provide control of tabletop 12, such that worksurface 14 may be easily manipulated between the substantially horizontal position and the substantially vertical position, as discussed below. The second end 26 of tabletop 12 includes a rounded, recessed area 32, which defines support portions 34 within tabletop 12. The worksurface 14 of tabletop 12 includes an erasable surface adapted to erasably receive markings thereon, such as those made by marker pens.

Figure 2B:
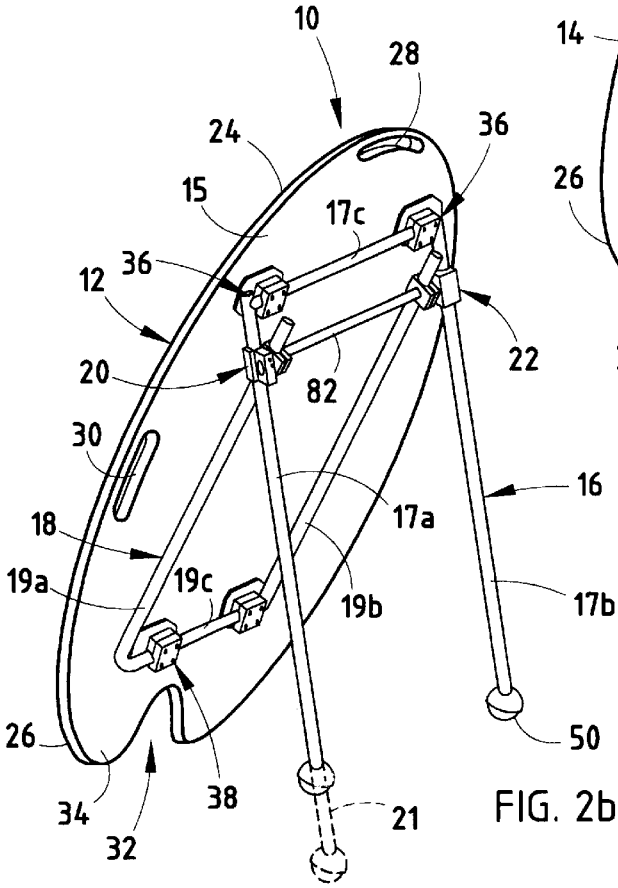
FIG. 2*b* is a rear perspective of the table/easel, with the worksurface in a substantially vertical position.
Figure 3:
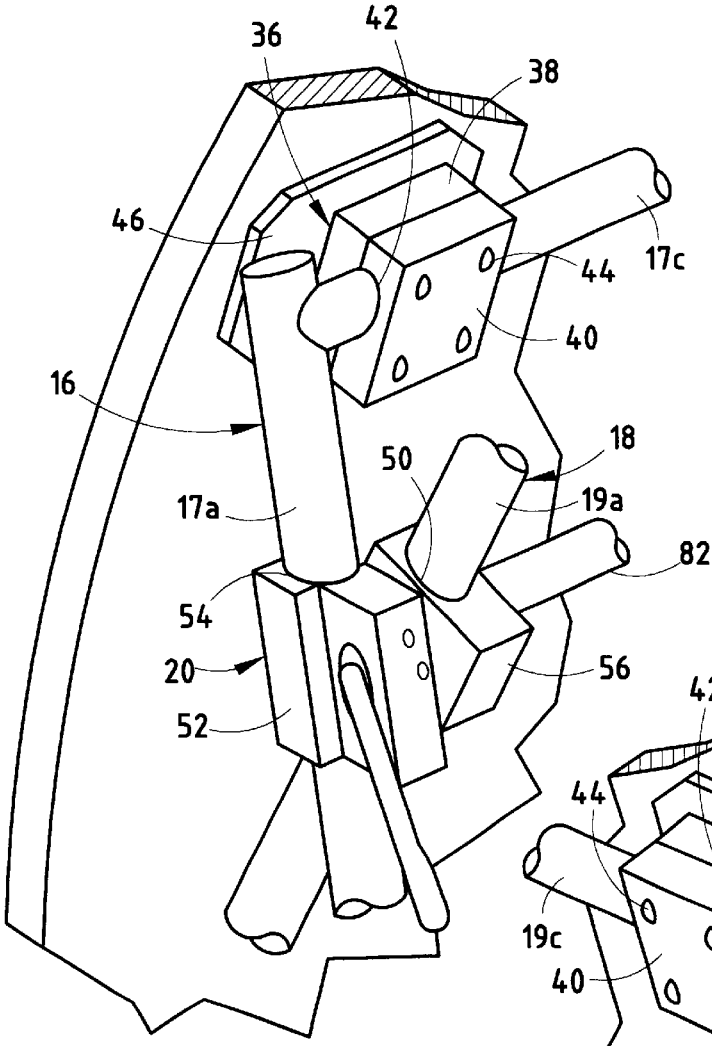
FIG. 3 is an enlarged perspective view of a first hinge block and a first pivot block.

The first leg 16 (FIG. 2*b*) and second leg 18 are each U-shaped and are provided a substantially circular cross-section. The first leg 16 includes a first support section 17*a*, a second support section 17*b* and a hinge section 17*c*. First leg 16 further includes leg extensions 21 that are telescopingly received within first support section 17*a* and second support section 17*b*, the utility of which is discussed below. The second leg 18 includes a first support section 19*a*, a second support section 19*b* and a hinge section 19*c*. Each support section 17*a* and 17*b* of first leg 16 are provided with a caster 35, which allow easy manipulation of the table/easel 10 across a floor or other supporting surface. The first leg 16 is pivotally attached to tabletop 12 by a pair of hinge blocks 36. Each hinge block 36 (FIG. 3) includes a top half 38 and a bottom half 40 which cooperate to define a bearing aperture 42 adapted to receive hinge section 17*c* of first leg 16 therein. A plurality of screws 44 secure bottom half 40 with top half 38 of hinge block 36. Each hinge block 36 is secured to bottom surface 15 of tabletop 12 by a mounting plate 46. The second leg 18 is pivotally attached to bottom surface 15 of tabletop 12 by hinge blocks 38 located near second end 26 of tabletop 12. Hinge blocks 38 are similar in construction and configuration to hinge blocks 36.

The first pivot block 20 includes a substantially rectangularly shaped first member 52 having an aperture 54 extending therethrough that telescopingly receives first support section 17*a* of first leg 16 therein. The first pivot block 20 also includes a second member 56 having an aperture 58 extending therethrough which telescopingly receives first support section 19*a* of second leg 18 therein. First member 52 and second member 56 of first pivot block 20 are constructed of a polymeric material, however, other materials which allow legs 16 and 18 to telescope within members 52 and 56, respectively may be substituted.

Figure 5:
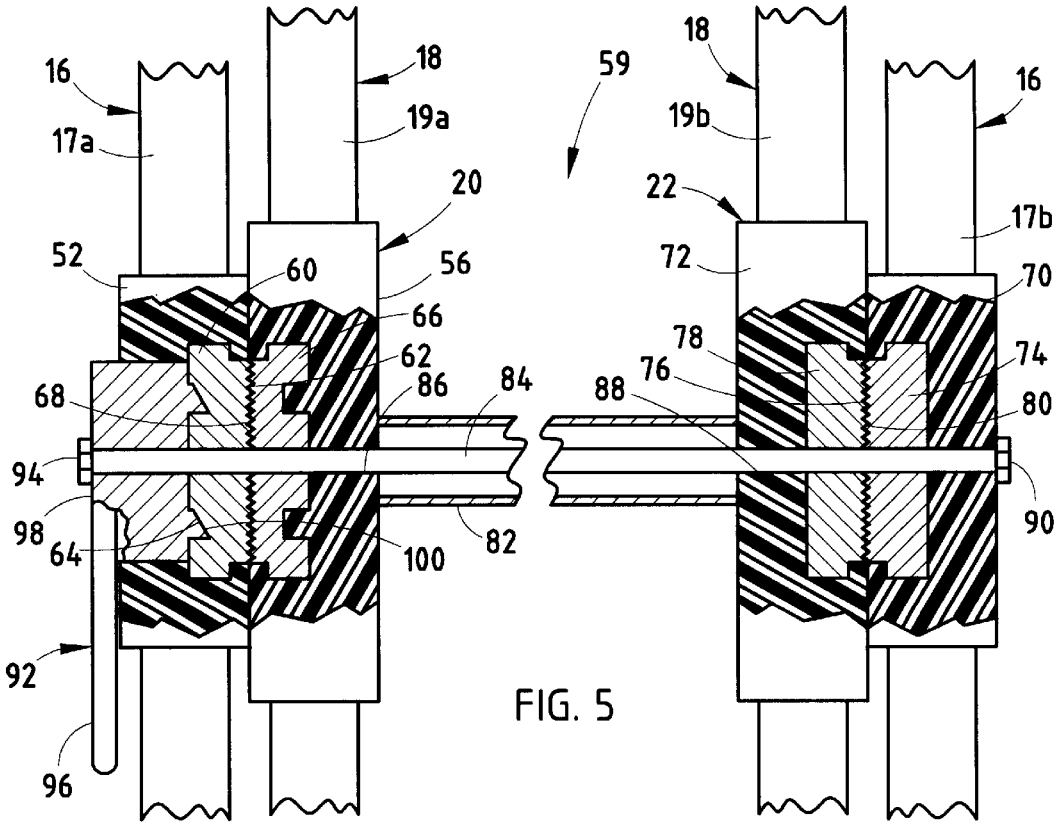
FIG. 5 is a cross-sectional view of a first embodiment of a clamping mechanism.

The numeral 59 (FIG. 5) generally designates a clamping mechanism of table/easel 10 that includes a first ratchet portion 60 is located within first member 52 of first pivot block 20 and is securely affixed therein. First ratchet portion 60 includes a ratchet surface 62 that extends outwardly from first member 52. First ratchet portion 60 further includes a first rotational cam surface 64 juxtaposed across first ratchet portion 60 from ratchet surface 62. A second ratchet portion 66 is fixedly attached to and located within second member 56 and includes a ratchet surface 68 that extends outwardly from second member 56. Ratchet surfaces 62 and 68 cooperate so as to restrict pivotal movement of first member 52 with respect to second member 56 of first pivot block 20, as discussed below.

Figure 4:
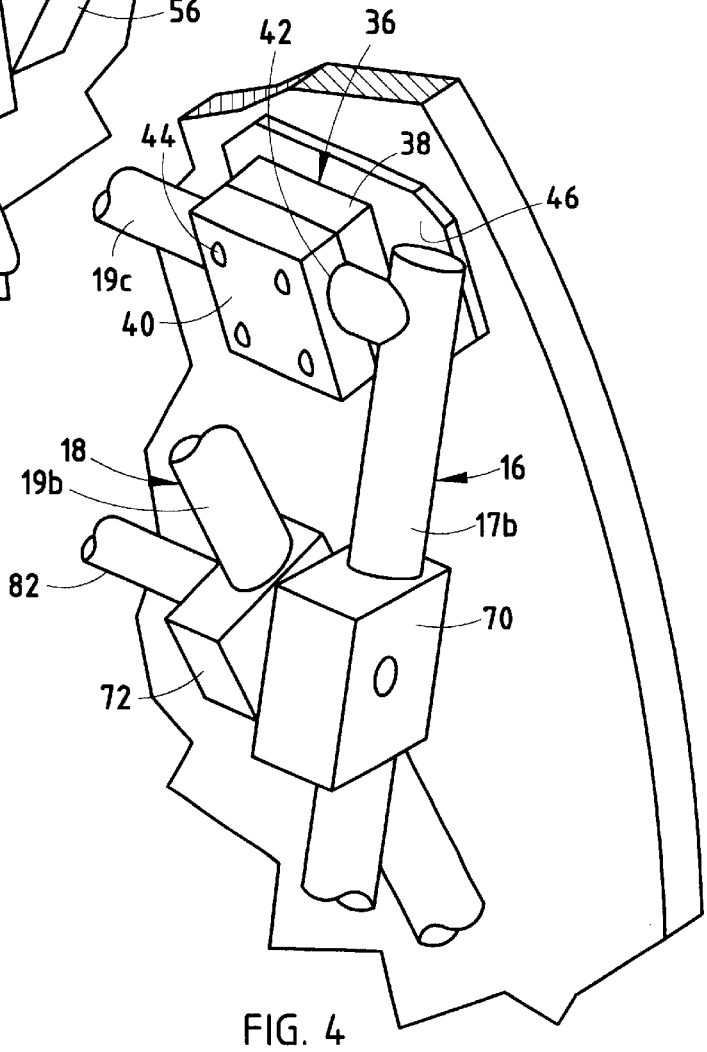
FIG. 4 is an enlarged perspective view of a second hinge block and a second pivot block.

The second pivot block 22 (FIGS. 4 and 5) includes a first member 70 and a second member 72 similar in configuration and construction to first member 52 and second member 56, respectively. A first ratchet portion 74 is fixedly attached to and located within first member 70 and includes a ratchet surface 76 that extends outwardly from first member 70. A second ratchet portion 78 is fixedly attached to and located within second member 72 and includes a ratchet surface 80 extending outwardly from second member 72. Ratchet surface 80 is adapted to mate with ratchet surface 76 of first member 70, thereby restricting pivotal movement of first member 70 with respect to second member 72, as discussed below.

A tie bar 82 extends between and is fixedly attached to second member 56 of first pivot block 20 and second member 72 of second pivot block 22 and biases first pivot block 20 and second pivot block 22 apart. A clamping rod 84 is located within tie bar 82 and extends through an aperture 86 extending through first pivot block 20 and an aperture 88 extending through second pivot block 22. Clamping rod 84 is held in position by a hexagonal locking nut 90 that contacts first member 70 of second pivot block 22, and an adjustment handle 92 that is held in place by a locking nut 94, and contacts first member 52 of first pivot block 20. Adjustment handle 92 includes a griping portion 96, an outer surface 98 and a second rotational cam surface 100 that is adapted to engage first rotational cam surface 64 of first ratchet portion 60. The clamping rod 84 defines an effective length that extends between second rotational cam surface 100 of adjustment handle 92 and locking nut 90. As adjustment handle 92 is rotated about clamping rod 84, the second rotational cam surface 100 of adjustment handle 92 and the first rotational cam surface 64 of first ratchet portion 60 cooperate to either increase or decrease the distance between second rotational cam surface 100 and locking nut 90, depending upon the direction of rotation of adjustment handle 92. As adjustment handle 92 is rotated towards an unlocked position, the distance between second rotational cam surface 100 and locking bolt 90 is increased, thereby allowing ratchet surfaces 62 and 68, as well as ratchet surfaces 76 and 80 to separate, and members 52 and 56, as well as members, 70 and 72 to pivot with respect to one another. Conversely, as adjustment handle 92 is rotated towards a locked position, the effective length between second rotational cam surface 100 and locking nut 90 is decreased, thereby causing ratchet surfaces 62 and 68, as well as ratchet surfaces 76 and 80, to engage one another, and restricting pivotal movement of members 52 and 56, as well as members 70 and 72, with respect to one another. By restricting the pivotal movement of first member 52 with respect to second member 56, and first member 70 with respect to second member 72, pivot blocks 20 and 22 are unable to telescope along legs 16 and 18 and the angle $\alpha$, as formed between first leg 16 and second leg 18, is held to a constant.

Figure 6:
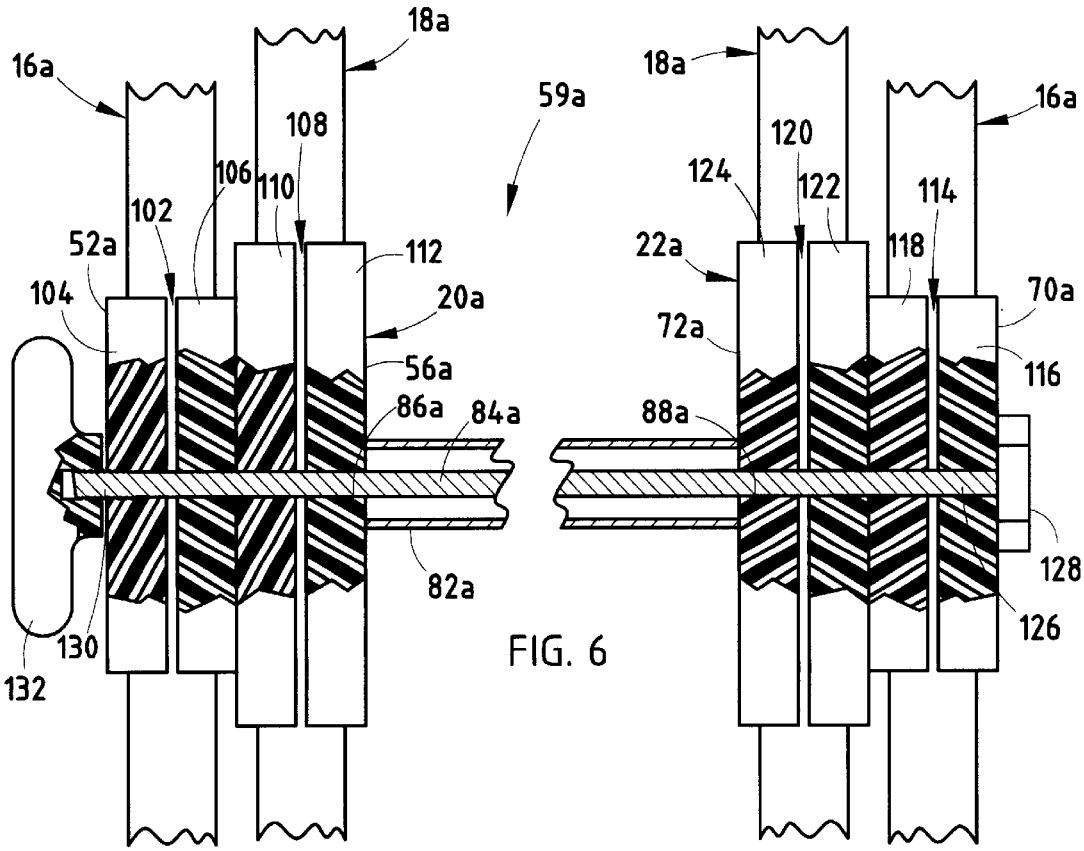
FIG. 6 is a cross-sectional view of an alternative embodiment of the clamping mechanism.

The reference 59*a* (FIG. 6) generally designates an alternative clamping mechanism of the present invention. In the illustrated example, a first pivot block 20*a* includes a first member 52*a* having a longitudinally extending channel 102 effectively dividing first member 52*a* into a first portion 104 and a second portion 106. First pivot block 20*a* also includes a second member 56*a* having a longitudinally extending channel 108 effectively dividing second member 56*a* into a first portion 110 and a second portion 112. A second pivot block 22*a* includes a first member 70*a* having a longitudinally extending channel 114 effectively dividing first member 70*a* into a first portion 116 and a second portion 118. The second pivot block 22*a* also includes a second member 72*a* having a longitudinally extending channel 120 that effectively divides second member 72*a* into a first portion 122 and a second portion 124. As illustrated, channels 102, 108, 114 and 120, extend only partially through members 52*a*, 56*a*, 70*a* and 72*a*, respectively, however, channels 102, 108, 114 and 120, may extend entirely through members 52*a*, 56*a*, 70*a* and 72*a*, respectively, thereby effectively dividing each member 52*a*, 56*a*, 70*a* and 72*a* into two pieces. A tie bar 82*a* extends between and is fixedly attached to second members 56*a* and 72*a*, and is adapted to bias first pivot block 20*a* and second pivot block 22*a* apart. A clamping rod 84*a* extends through an aperture 86*a* extending through first pivot block 20*a* and an aperture 88*a* extending through second pivot block 22*a*. Clamping rod 84*a* has a threaded first end 126 that threadably receives a locking nut 128 thereon, and a threaded second end that threadably receives an adjustment knob 132 thereon. Clamping rod 84*a* defines an effective length that extends between locking nut 128 and adjustment knob 132.

In adjustment, as adjustment knob 132 is threadably tightened on to clamping rod 84*a*, the distance between the adjustment knob 132 and locking nut 128 is shortened, thereby shortening the effective length of clamping rod and placing a compression force on first pivot block 20*a* and second pivot block 22*a*. As the compression force is increased, channels 102, 108, 114 and 120 are compressed and members 52*a*, 56*a*, 70*a* and 72*a* frictionally engage legs 16*a* and 18*a*, thereby restricting the telescoping movement of legs 16*a* and 18*a* within pivot blocks 20*a* and 22*a*. In contrast, adjustment knob 132 may be rotated in an opposite direction resulting in an increase in distance between adjustment knob 132 and locking nut 128, thereby increasing the effective length of clamping rod 84*a* and allowing channels 102, 108, 114 and 120 to expand and legs 16*a* and 18*a* to be telescopingly adjusted within pivot blocks 20*a* and 22*a*.

Figure 7:
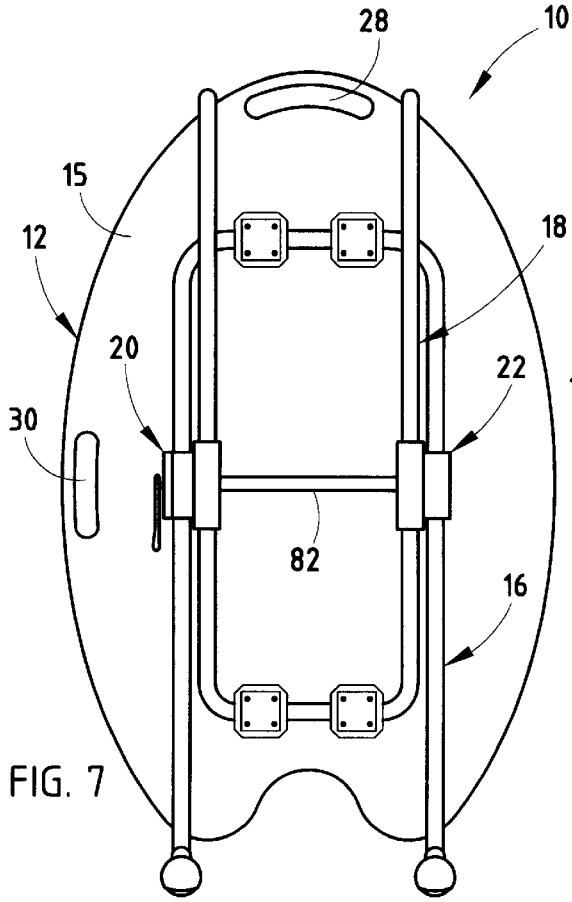
FIG. 7 is a perspective view of the table/easel with a first and second leg shown in a storage position.
Figure 8:
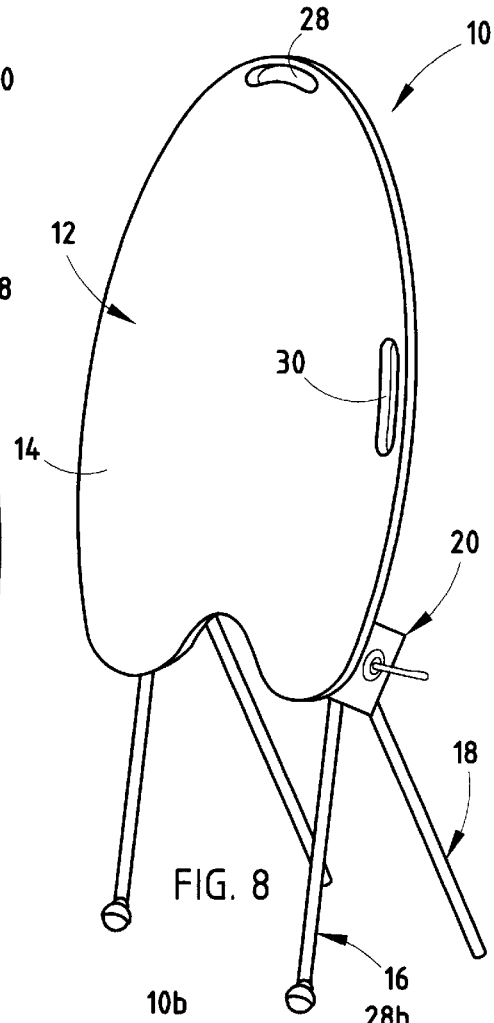
FIG. 8 is a front perspective view of the table/easel with the worksurface in substantially raised vertical position.

Table/easel 10 may be adjusted and manipulated into a plurality of useful orientations including an orientation in which worksurface 14 is substantially horizontal, as shown in FIG. 1, thereby allowing tabletop 12 to be utilized for things such as a desk or conference table. Other orientations include a lowered easel configuration, as shown in FIG. 2*a*, wherein the worksurface 14 is substantially vertically oriented and tabletop 12 is supported by either first leg 16 or second leg 18, and support portions 34 of tabletop 12. Another configuration includes a storage configuration, as shown in FIG. 7, wherein legs 16 and 18 are raised such that each leg 16 and 18, is closely located and extends along bottom surface 15 of worksurface 12, thereby providing a compact overall configuration of table/easel 10 allowing easy storage thereof. Yet another configuration includes a raised easel configuration, as shown in FIG. 8, wherein pivot blocks 20 and 22 are telescopingly positioned at a lower end of leg 16 and leg extension 21 are telescopingly extended from within leg 16, thereby supporting table/easel 10 by leg extensions 21 of leg 16 and leg 18 in a raised easel configuration. The adjustability of table/easel 10 allows for effective use of table/easel 10 in numerous work zones including a zone in which the user sits on the floor, a zone in which the user sits on a chair, and a zone in which the user is standing.

The reference 10*b* (FIG. 9) generally designates another embodiment of the present invention of a convertible table/easel. Since table/easel 10*b* is similar to previously described table/easel 10*a*, similar parts appearing in FIG. 1 and FIG. 9 are represented by the same, corresponding reference numeral, except for the suffix "b" in the numerals of the latter. Table/easel 10*b* includes a tabletop 12*b* having a worksurface 14*b* and a bottom surface 15*b*. The tabletop 12*b* is provided a substantially oval-shaped geometry, and includes a first end 24*b* and a second end 26*b*. The first end 24*b* of tabletop 12*b* includes an arcuate-slotted handle 28*b* extending therethrough. A second slotted handle 30*b* also extends through tabletop 12*b* near an edge thereof. Slotted handles 28*b* and 30*b* are adapted to provide control of tabletop 12*b*, such that worksurface 14*b* may be easily manipulated between the substantially horizontal position and the substantially vertical position, as discussed below. The second end 26*b* of tabletop 12*b* includes a rounded, recessed area 32*b*, which defines support portions 34*b* within tabletop 12*b*. The worksurface 14*b* of tabletop 12*b* includes an erasable surface adapted to erasably receive markings thereon, such as those made by marker pens.

Table/easel 10*b* also includes a plurality of legs 134 pivotally attached to bottom surface 15*b* of tabletop 12*b*. Each leg 134 is rotatable between an in-use or first position wherein the leg 134 is substantially perpendicular to tabletop 12*b*, and a storage or second position wherein leg 134 is rotated such that it extends along tabletop 12*b*, thereby providing for easy storage. At least two of the legs 134 are provided with a caster 136 attached to the distal ends thereof.

Figure 10:
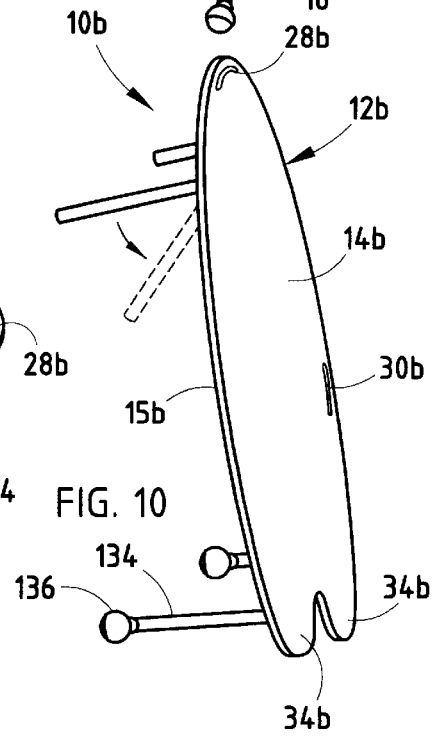
FIG. 10 is a perspective view of the alternative embodiment of the table/easel with the worksurface located in a substantially vertical position.

Table/easel 10*b* may be adjusted and manipulated into a plurality of useful orientations including an orientation in which worksurface 14*b* is substantially horizontal, thereby allowing tabletop 12*b* to be utilized for things such as a desk or conference table, as illustrated in FIG. 9. Table/easel 10*b* may also be used as a display easel, wherein the worksurface 14*b* is substantially vertically oriented and tabletop 12*b* is supported by two legs 134 and support portions 34*b* of tabletop 12*b*, as shown in FIG. 10.

The table/easel of the present invention provides a table usable as a worksurface such as a desk or conference table, and a display easel, in the same unit, thereby reducing the costs associated with purchasing office furniture capable of each individual task or function. The present inventive table/easel also reduces the amount of office space that would be required to use and store separate pieces of equipment. The present inventive table/easel can be operated by even unskilled office personnel, is efficient in use, is economical to manufacture and is particularly well adapted for the proposed alternative uses.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A table/easel, comprising:

a tabletop having a worksurface with an erasable surface;

at least one first leg pivotally coupled to the worksurface;

at least one second leg pivotally coupled to the worksurface; and a first pivot block and a second pivot block interconnecting the first and second legs in a scissor-like arrangement, wherein the first and second pivot blocks are slidably coupled to the first and second legs; and a tie rod interconnecting the first pivot block and the second pivot block;

a clamping rod having an adjustable effective length and extending through the first and second portion of each member, such that adjusting the length of the clamping rod moves the first portion and the second portion of each member with respect to one another; and wherein the first and second leg can be slidably adjusted with respect to the first and second pivot blocks, thereby allowing infinite adjustability of the worksurface between a substantially horizontal position and a substantially vertical position, and wherein the first and second pivot block each including a first member having an aperture slidingly receiving the first leg, and a second member having an aperture slidingly receiving the second leg, the slidable adjustment of the first and second leg with respect to the first and second pivot blocks includes slidingly adjusting the first and second legs with the first and second pivot blocks, the first member and the second member of each pivot block includes a first portion and a second portion moveable with respect to one another, such that movement of the first portion and the second portion with respect to one another changes a size of the aperture in the member, and wherein the size of the aperture can be adjusted between a locked condition wherein the sliding motion of the legs within the first and second pivot blocks is restricted, and an unlocked condition wherein the legs may be slidingly adjusted.

2. The table/easel of claim 1, wherein the clamping rod has a threaded first end and a threaded second end, and wherein a clamping nut is threadably engaged on the first end of the clamping rod and an adjustment knob is threadably engaged on the second end of the clamping rod, such that threadably adjusting the adjustment knob adjusts the effective length of the clamping rod.

3. A table/easel, comprising:

a tabletop having a worksurface with an erasable surface;

at least one first leg pivotally coupled to the worksurface;

at least one second leg pivotally coupled to the worksurface; and a first pivot block and a second pivot block interconnecting the first and second legs in a scissor-like arrangement, the first and second pivot blocks slidably coupled to the first and second legs, wherein the first and second pivot block each including a first member having an aperture slidably receiving the first leg, and a second member having an aperture slidably receiving the second leg, the first and second legs define an angle therebetween, and wherein the first member is pivotally attached to the second member of each pivot block; and wherein the first and second leg can be slidably adjusted with respect to the first and second pivot blocks, the slidable adjustment of the first and second leg with respect to the first and second pivot blocks including slidingly adjusting the first and second legs with the first and second pivot blocks, thereby allowing infinite adjustability of the worksurface between a substantially horizontal position and a substantially vertical position, and wherein the first member may be pivotally locked with the second member, thereby fixing the angle between the legs and restricting the sliding adjustability of the legs within the pivot blocks.

4. The table/easel of claim 3, wherein the first member of each pivot block includes a first ratchet half and the second member of each pivot block includes a second ratchet half releasably engageable with the first ratchet half, thereby pivotally locking the first member with the second member of each pivot block.

5. The table/easel of claim 4, further including a tie bar extending between the second member of each pivot block and biasing the second members apart, and a clamping rod having an adjustable effective length and extending through the first and second member of each pivot block, and wherein adjusting the effective length of the clamping rod engages and disengages the first ratchet half with the second ratchet half of each pivot block.

6. The table/easel of claim 5, further including an adjustment knob threadably engaging the clamping rod, wherein threadably adjusting the adjustment knob on the clamping rod adjusts the effective length of the clamping rod.

7. The table/easel of claim 5, further including an actuator handle having a first cammed surface and rotationally attached to the clamping rod, wherein a select one of the first pivot block and the second pivot block has a second cammed surface adapted to engage the first cammed surface, and wherein rotating the handle causes the first cammed surface to engage the second cammed surface, thereby adjusting the effective length of the clamping rod.

8. A table/easel, comprising:

a tabletop defining a top worksurface with an erasable surface and a bottom surface;

at least one first leg pivotally coupled to the tabletop;

at least one second leg pivotally coupled to the tabletop; and a first pivot block and a second pivot block interconnecting the first and second legs in a scissor-like arrangement, the first and second pivot blocks slidingly coupled to the first and second legs wherein the first and second legs define an angle therebetween, and wherein the first member is pivotally attached to the second member of each pivot block; and wherein the first and second leg can be slidingly adjusted with respect to the first and second pivot blocks, thereby allowing infinite adjustability of the worksurface between a storage position wherein the legs are collapsed against the bottom surface of the tabletop, and an in-use position wherein the legs extend away from the tabletop and wherein the first member may be pivotally locked with the second member, thereby fixing the angle between the legs and restricting the sliding adjustability of the legs.

9. The table/easel of claim 8, wherein the first member of each pivot block includes a first ratchet half and the second member of each pivot block includes a second ratchet half releasably engageable with the first ratchet half, thereby pivotally locking the first member with the second member of each pivot block.

10. The table/easel of claim 9, further including a tie bar extending between the second member of each pivot block and biasing the second members apart, and a clamping rod having an adjustable effective length and extending through the first and second member of each pivot block, and wherein adjusting the effective length of the clamping rod engages and disengages the first ratchet half with the second ratchet half of each pivot block.

11. The table/easel of claim 10, further including an adjustment knob threadably engaging the clamping rod, wherein threadably adjusting the adjustment knob on the clamping rod adjusts the effective length of the clamping rod.

12. The table/easel of claim 11, further including an actuator handle having a first cammed surface and rotationally attached to the clamping rod, wherein a select one of the first pivot block and the second pivot block has a second cammed surface adapted to engage the first cammed surface, and wherein rotating the handle causes the first cammed surface to engage the second cammed surface, thereby adjusting the effective length of the clamping rod.

13. The table/easel of claim 12, wherein the legs are U-shaped.

14. A convertible furniture unit, comprising:

a worksurface panel with an erasable surface;

a pair of intersecting legs pivotally attached to the worksurface panel, wherein the legs define an angle therebetween, and wherein the length of one of the legs is adjustable; and a bracket interconnecting the intersecting legs which is securely repositionable along the lengths of each of the legs, and wherein the bracket includes a first pivot block interconnecting the legs in a scissor-like arrangement, the pivot block includes a first member having an aperture slidingly receiving one of the legs, and a second member having an aperture slidingly receiving the leg not received by the first member, the legs can be slidably adjusted with respect to the pivot blocks, and wherein the slidable adjustment of the legs with respect to the first and second pivot blocks includes slidingly adjusting the legs with the first and second pivot blocks thereby allowing infinite adjustability of the worksurface between a substantially horizontal position and a substantially vertical position, the first member is pivotally attached to the second member, and wherein the first member may be pivotally locked with the second member, thereby fixing the angle between the legs and restricting the telescoping adjustability of the legs within the pivot block.

15. The convertible furniture unit of claim 14, wherein the first member of the pivot block includes a first ratchet half and the second member of the pivot block includes a second ratchet half releasably engageable with the first ratchet half, thereby pivotally locking the first member with the second member of the pivot block.

16. The convertible furniture unit of claim 15, further including a clamping rod having an adjustable effective length and extending through the first and second member of the pivot block, and wherein adjusting the effective length of the clamping rod engages and disengages the first ratchet half with the second ratchet half of the pivot block.

17. The convertible furniture unit of claim 16, further including an adjustment knob threadably engaging the clamping rod, wherein threadably adjusting the adjustment knob on the clamping rod adjusts the effective length of the clamping rod.

18. The convertible furniture unit of claim 17, further including an actuator handle having a first cammed surface and rotationally attached to the clamping rod, wherein a select one of the pivot block has a second cammed surface adapted to engage the first cammed surface, and wherein rotating the handle causes the first cammed surface to engage the second cammed surface, thereby adjusting the effective length of the clamping rod.

* * * * *

UNITED STATES PATENT AND TRADEMARK OFFICE

CERTIFICATE OF CORRECTION

PATENT NO. : 6,575,103 B1
DATED : June 10, 2003
INVENTOR(S) : Holdredge et al.

It is certified that error appears in the above-identified patent and that said Letters Patent is hereby corrected as shown below:

Title page,
Item [57], ABSTRACT,
Line 9, “leg” should be -- legs --.

Column 1,
Lines 28 and 41, “leg” should be -- legs --.

Column 3,
Line 6, “vertically” should be -- vertical --.
Lines 21-22, “cross-section” should be -- cross section --.

Column 5,
Line 54, “extension 21” should be -- extensions 21 --.

Column 7,
Lines 4, 12, 48 and 50, “leg” should be -- legs --.
Line 9, “block” should be -- blocks --.

Column 8,
Line 33, “leg” should be -- legs --.

Signed and Sealed this

Seventh Day of October, 2003

JAMES E. ROGAN
*Director of the United States Patent and Trademark Office*